US010620586B2

(12) United States Patent
Charbon

(10) Patent No.: US 10,620,586 B2
(45) Date of Patent: Apr. 14, 2020

(54) ECONOMICAL TIMEPIECE DISPLAY COMPONENT

(71) Applicant: Nivarox-FAR S.A., Le Locle (CH)

(72) Inventor: Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 320 days.

(21) Appl. No.: 15/450,211

(22) Filed: Mar. 6, 2017

(65) Prior Publication Data

US 2017/0261935 A1 Sep. 14, 2017

(30) Foreign Application Priority Data

Mar. 14, 2016 (EP) ..... 16160071

(51) Int. Cl.
*G04B 19/04* (2006.01)
*G04B 19/10* (2006.01)
(Continued)

(52) U.S. Cl.
CPC ..... *G04B 19/042* (2013.01); *G04B 19/10* (2013.01); *G04B 19/103* (2013.01); *G04B 19/12* (2013.01);
(Continued)

(58) Field of Classification Search
CPC ..... B29L 2031/739; C25D 7/005; C25D 5/56; G04B 19/042; G04B 19/06;
(Continued)

(56) References Cited

U.S. PATENT DOCUMENTS 4,371,429 A 2/1983 Enomoto et al.
4,404,067 A 9/1983 Enomoto
(Continued)

FOREIGN PATENT DOCUMENTS

CH 280 563 A 1/1952
CH 701 442 A2 1/2011
(Continued)

OTHER PUBLICATIONS

CH701442 Translation (Year: 2011).*
(Continued)

*Primary Examiner* — Matthew P Travers
(74) *Attorney, Agent, or Firm* — Sughrue Mion, PLLC

(57) ABSTRACT

Economical method for manufacturing a timepiece display or hand-fitting component, wherein:

there is chosen a first material which is easy to shape or to machine;

a workpiece is made in the first material;

a second material is chosen to make each aesthetical and/or visible surface of component, which is an amorphous metal alloy or has a nanocrystalline structure or includes nickel or nickel-phosphorus, or which is a pure metal or an alloy of gold and/or silver and/or copper and/or rhodium and/or titanium and/or aluminium;

the workpiece is coated, at least on the surfaces intended to remain visible on the component, with a thick layer, of an initial thickness greater than 20 micrometres, of the second material;

at least one aesthetical and/or visible surface, is diamond tool machined, removing all or part of the thick layer.

21 Claims, 2 Drawing Sheets

(51) Int. Cl.
*G04D 3/00* (2006.01)
*G04B 19/12* (2006.01)

(52) U.S. Cl.
CPC ..... *G04D 3/0046* (2013.01); *G04D 3/0051* (2013.01)

(58) Field of Classification Search
CPC ..... G04B 19/10–106; G04B 19/12; G04B 37/22; G04B 37/226; Y10T 29/49579; Y10T 29/49583; Y10T 29/49597; A44C 27/005; G04D 3/0092
See application file for complete search history.

(56) References Cited

U.S. PATENT DOCUMENTS 5,761,158 A * 6/1998 Azuma ..... G04B 19/065 136/251
2005/0160574 A1* 7/2005 Bazin ..... G04B 19/103 29/557
2009/0139264 A1* 6/2009 Brown ..... A44C 27/00 63/15
2013/0130057 A1* 5/2013 Caldwell ..... C25D 1/00 428/626
2014/0044990 A1* 2/2014 Tsukamoto ..... A44C 27/006 428/661
2015/0283791 A1* 10/2015 Yamashita ..... C04B 35/6455 428/34.7
2016/0266551 A1* 9/2016 Oliveira ..... G04D 3/0092
2017/0268111 A1* 9/2017 Manasterski ..... C23C 14/14

FOREIGN PATENT DOCUMENTS

EP 2 182 096 A1 5/2010
GB 2 032 657 A 5/1980
JP 63-42395 A 2/1988

OTHER PUBLICATIONS

Anonymous, "Diamantage pour des surfaces plus fins", Oct. 17, 2016, XP055311486, Extrait de l'Internet: URL:http://www.samuelwerder.ch/lexikon/intro/info.asp?IDWissen=5&userlang=FR.
N. N., "Dictionnaire professionel illustre de l'horlogerie—diamantage", Jan. 1, 2016, XP055311965, Extrait de l'Internet: URL:http://www.fhs.swiss/berner/?l=fr.
European Search Report of European Application No. 16 16 0071.3 dated Dec. 22, 2016.

* cited by examiner

ECONOMICAL TIMEPIECE DISPLAY COMPONENT

This application claims priority from European Patent Application No 16160071.3 of Mar. 14, 2016, the entire disclosure of which is hereby incorporated herein by reference.

FIELD OF THE INVENTION

The invention concerns an economical method for manufacturing a timepiece display or hand-fitting component including at least one aesthetical 10 and/or visible surface.

The invention concerns the field of timepiece display or hand-fitting components.

BACKGROUND OF THE INVENTION

In horology, the manufacture of small display, hand-fitting or external components always poses practical problems of production, owing to the importance of these components in the outward appearance of a watch and how it is evaluated by the client or user.

Indeed, the user's gaze is necessarily drawn to these components, which must therefore have a flawless appearance, a very fine but also very regular surface finish, and, generally, brightness and reflection qualities that are difficult to obtain in a reproducible manner. Indeed, components such as appliques are distributed in large numbers over the watch dial, and must be perfectly identical.

The production cost of these components and their weight must also be kept under control, especially when they are mobile, like hands. Consequently, convenient solutions consisting, in luxury horology, of machining the components in a precious alloy weight, like gold, are not always the most suitable.

It is also known that manufacturing such components with prior machining followed by a surface treatment generates a relatively high scrap rate, since the treatment reveals visual and/or surface defects that were not visible at the machining stage, and is therefore wasted, when it is expensive because of the desired finish.

SUMMARY OF THE INVENTION

The invention proposes to develop an alternative method for producing, at controlled cost, timepiece display or hand-fitting components comprising at least one aesthetical and/or visible surface, while ensuring the visual and surface reproducibility of these aesthetical and/or visible surfaces, with improved reliability of production compared to the prior art.

To this end, the invention concerns a manufacturing method according to claim 1.

BRIEF DESCRIPTION OF THE DRAWINGS

Other features and advantages of the invention will appear upon reading the following detailed description, with reference to the annexed drawings, in which:

FIG. 1 represents the manufacture of a workpiece in a first material.

FIG. 2 represents a blank formed by the same workpiece, coated with a thick layer of a second material.

FIG. 3 represents the diamond machining of an upper aesthetical and/or visible surface of this blank.

FIG. 4 represents the component finished by diamond machining all the aesthetical and/or visible surfaces of the blank.

FIG. 5 shows a perspective view of one such finished and ready-to-use component.

FIGS. 6 to 13 show schematic, perspective views of non-limiting examples of implementation of the invention:

FIG. 6 represents a hollow hand, with transverse and longitudinal cross-sections in FIGS. 6A and 6B.

FIG. 7 represents an applique provided with two feet.

FIG. 8 represents a numeral provided with two feet.

FIG. 9 represents a symbol provided with two feet.

FIG. 10 represents a monogram provided with one foot.

FIG. 11 represents an indicator.

FIG. 12 represents an index provided with two feet.

FIG. 13 represents an aperture surround provided with four feet.

DETAILED DESCRIPTION OF PREFERRED EMBODIMENTS

Figure 1:
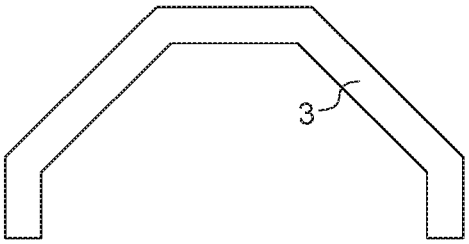
FIGS. 1 to 10 show schematic and cross-sectional views of different steps for implementation of the method according to the invention, in different alternatives.
Figure 2:
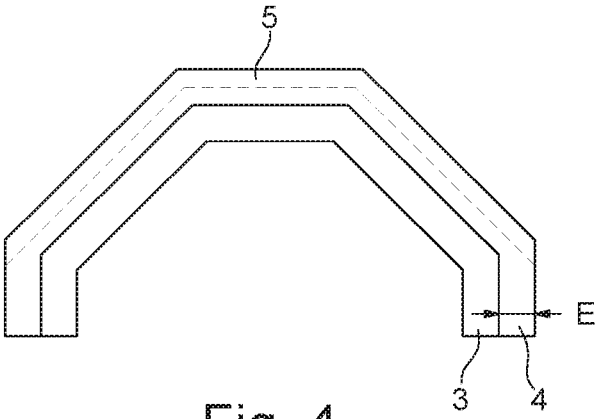
Figure 3:
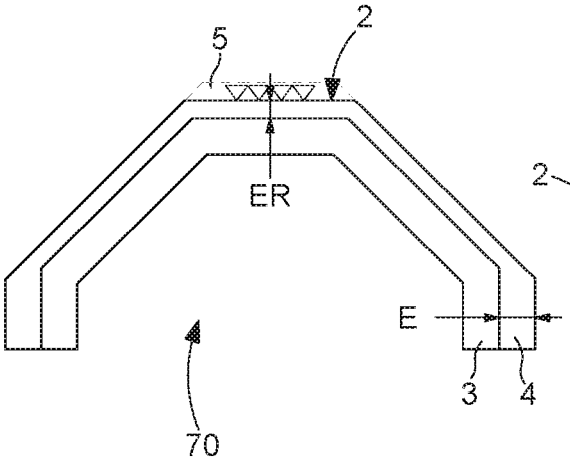
Figure 4:
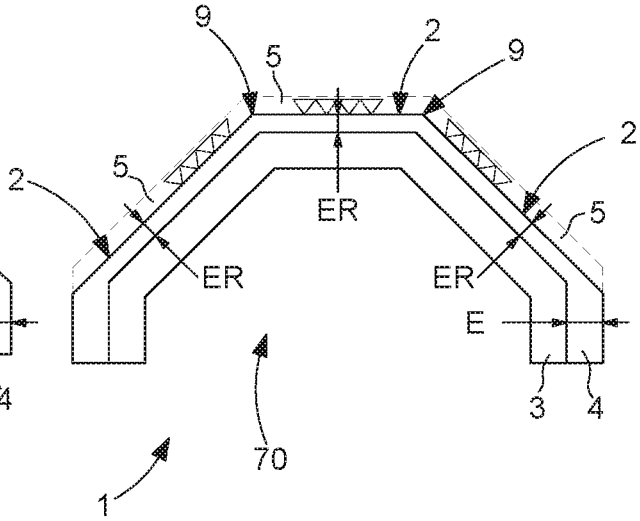
Figure 5:
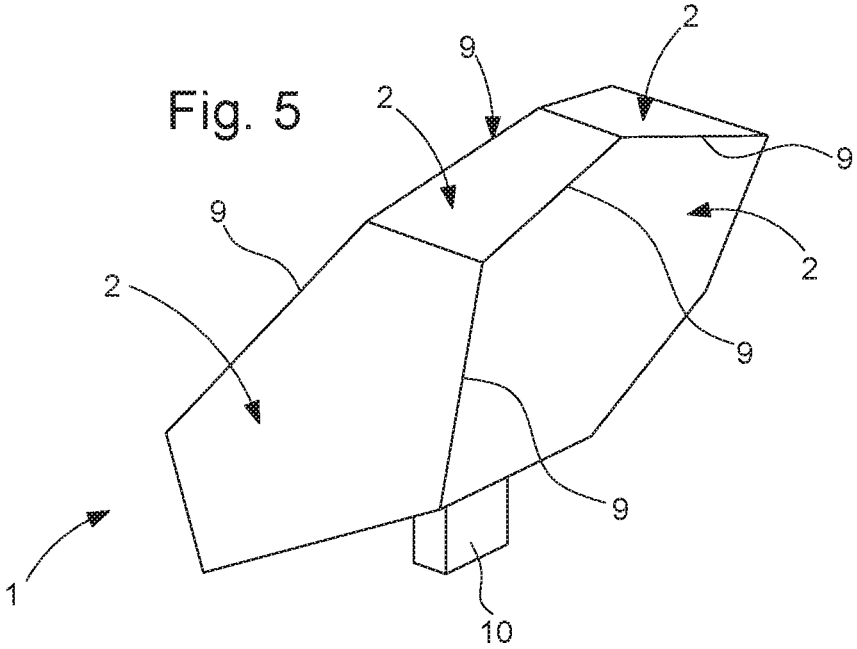
Figure 6:
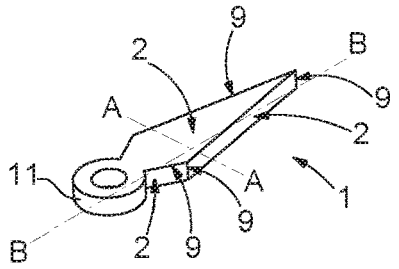
Figure 6A:
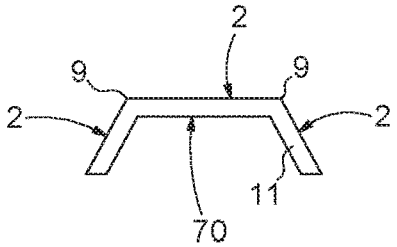
Figure 6B:
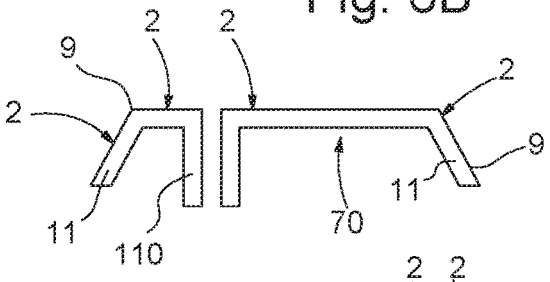
Figure 7:
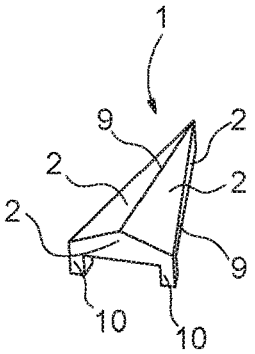
Figure 8:
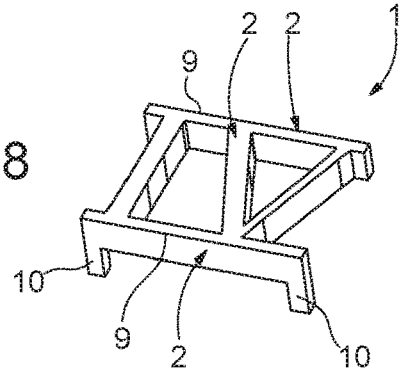
Figure 9:
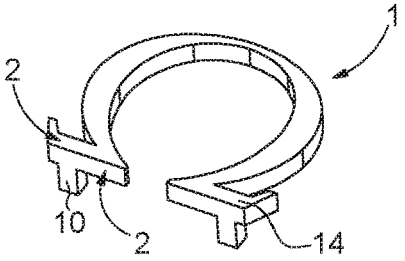
Figure 10:
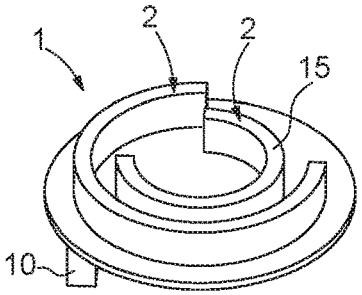
Figure 11:
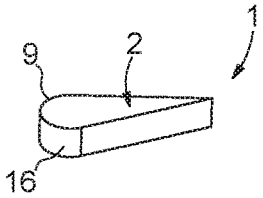
Figure 12:
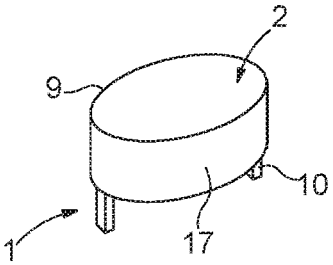
Figure 13:
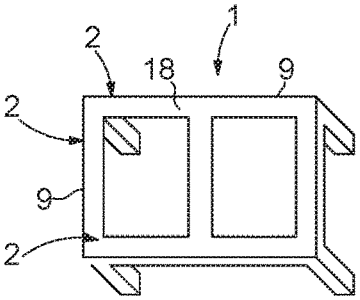
Figure 14:
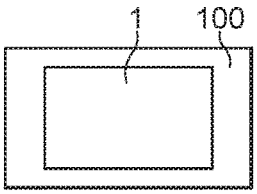
FIG. 14 is a block diagram featuring a watch comprising a component made by the method according to the invention.

The invention proposes to reduce both the cost and the weight of external or hand-fitting components, while ensuring a flawless appearance for such visible components and reducing manufacturing scrap as far as possible.

The invention proposes to form a component whose surface portion is made in a material compatible with finishing machining in order to obtain a regular surface finish with very low roughness.

This surface portion is formed in a thickness sufficient to ensure the homogeneity of the material, and thus to guarantee the final finish quality after machining.

The preferred finishing machining is diamond tool machining.

The invention thus concerns an economical method for manufacturing a timepiece display or hand-fitting component 1, formed by a hand 11, an applique 12, or similar, comprising at least one aesthetical and/or visible surface 2 intended to be visible to the user of a watch or similar.

According to the invention, the following steps are performed in succession:

- there is chosen a first material that is easy to shape by deformation and/or machining and/or injection and/or casting and/or galvanic growth, in order to make a workpiece 3;
- a workpiece 3 is made in this first material;
- a second material is chosen to make each aesthetical and/or visible surface 2, which is an amorphous metal alloy or has a nanocrystalline structure or includes nickel or nickel-phosphorus, or which is a pure metal or an alloy of gold and/or silver and/or copper and/or rhodium and/or titanium and/or aluminium;
- workpiece 3 is coated, at least on the surfaces intended to remain visible on the component in its operating position, with a thick layer 4, of an initial thickness E greater than or equal to 20 micrometres, of the second material;
- at least one aesthetical and/or visible surface 2 intended to remain visible is diamond machined, removing at least one part of an overthickness 5 comprised in thick layer 4 of the second material, with respect to the geometric position of the aesthetical and/or visible surface 2 concerned.

More particularly, overthickness 5 is entirely removed over the aesthetical and/or visible surface 2 concerned, during this first diamond machining operation, which may also be the only operation, depending on the appearance desired for the finished component 1.

In a particular implementation of the invention, thick layer 4 of the second material is made with an initial thickness E greater than or equal to 50 micrometres.

In a particular implementation of the invention, component 1 is made with at least one such aesthetical and/or visible surface 2 bordered by a protruding edge 9, and, during diamond machining, protruding edge 9 is made and delimits aesthetical and/or visible surface 2.

In a particular implementation of the invention, during the diamond machining operation, all the aesthetical and/or visible surfaces 2 intended to remain visible are diamond machined, removing at least part of overthickness 5 comprised in thick layer 4 of the second material, and, when comprised in component 1, all the protruding edges 9 which delimit these aesthetical and/or visible surfaces 2 are diamond machined.

In a particular implementation of the invention, during the diamond machining operation, at least one aesthetical and/or visible surface 2 intended to remain visible is diamond machined, removing part of thick layer 4 of the second material, with a surface condition comprised between 2 nm Ra and 100 nm Ra.

In a particular implementation of the invention, during the diamond machining operation, there is kept a residual thickness ER greater than or equal to 5 micrometres of thick layer 4 of the second material, on each aesthetical and/or visible surface 2.

In a particular implementation of the invention, during the diamond machining operation, at least 50% of initial thickness E of thick layer 4 of the second material is removed.

In a particular implementation of the invention, a galvanic or PVD or CVD or ALD colouring operation is performed to a small thickness of less than 5 micrometres, on at least aesthetical and/or visible surfaces 2 intended to remain visible, after the diamond machining operation.

In a particular implementation of the invention, the first material is chosen from among alloys of copper and/or aluminium and/or zinc.

In a particular implementation of the invention, brass is chosen for the first material.

In a particular implementation of the invention, an aluminium alloy is chosen for the first material.

In a particular implementation of the invention, a zinc alloy is chosen for the first material.

In a particular implementation of the invention, a POM or PS or PC or polymer is chosen for the first material.

In a particular implementation of the invention, a charged material is chosen for the first material to make it electrically conductive.

In a particular implementation of the invention, the second material is chosen to be different from the first material.

In a particular implementation of the invention, nickel-phosphorus is chosen for the second material.

In a particular implementation of the invention, workpiece 3 is coated with thick layer 4 of the second material by bulk chemical deposition.

In a particular implementation of the invention, workpiece 3 is coated with thick layer 4 of the second material by electrodeposition.

In a particular implementation of the invention, workpiece 3 is made by deformation or stamping or punching.

In a particular implementation of the invention, workpiece 3 is made hollow and/or including at least one mounting foot 10.

The creation of a hollow component 1, with a cavity 70 is advantageous in terms of weight and economy of materials, in particular when component 1 is a hand 11, shown here with a pipe 110, thereby minimising the unbalance.

In various particular implementations of the invention, display or hand-fitting component 1 is made in the form of a hand 11 or an applique 12 or a numeral 13 or a symbol 14 or a monogram 15 or an indicator 16 or an index 17 or an aperture surround 18.

The invention also concerns a watch 100 including at least one display or hand-fitting component 1 made by this method.

The diamond tool machined finish of such a component is distinguished by the perfect quality of its surface condition (mirror) and by the intersection of the sides which define sharp edges, which cannot be ensured by any other manufacturing method.

What is claimed is:

1. A method of manufacturing a timepiece display or hand-fitting component including at least one visible surface, wherein the following steps are performed in succession:

choosing a first material shapeable by deformation, and/or machining and/or injection and/or casting and/or galvanic growth, in order to make a workpiece;

making a workpiece in said first material, choosing a second material to make the visible surface, wherein the second material is an amorphous metal alloy or has a nanocrystalline structure or includes nickel or nickel-phosphorus, or which is a pure metal or an alloy of gold and/or silver and/or copper and/or rhodium and/or titanium and/or aluminium;

coating said workpiece, at least on a position of the visible surface, with a thick layer, of an initial thickness greater than or equal to 20 micrometres, of said second material;

diamond tool machining the visible surface which is intended to remain visible, removing at least part of said, thick layer of said second material, wherein, during said diamond tool machining, at least the visible surface intended to remain visible is diamond machined, removing part of said thick layer of said second material, with a surface condition comprised between 2 nm Ra and 50 nm Ra, and wherein at least another part of the thick layer remains at the initial thickness after the diamond tool machining.

2. The method according to claim 1, wherein said thick layer of said second material comprises a thickness greater than or equal to 50 micrometres.

3. The method according to claim 1, wherein said display or hand-fitting component is made with at least the visible surface bordered by a protruding edge, wherein, said protruding edge, which delimits the visible surface, is made during the diamond machining.

4. The method according to claim 1, wherein, during said diamond tool machining, the visible surface is diamond machined by removing part of said thick layer of said second material, and protruding edges which delimit the visible surface are also diamond machined.

5. The method according to claim 1, wherein, during said diamond tool machining, there is kept a residual thickness greater than or equal to 5 micrometres of another part of said thick layer of said second material, on the visible surface.

6. The method according to claim 1, wherein, during said diamond tool machining, at least 50% of an initial thickness of another part of said thick layer of said second material is removed.

7. The method according to claim 1, wherein a galvanic or PVD or CVD or ALD or chemical colouring operation is performed to a small thickness of less than 5 micrometres, on at least the visible surface intended to remain visible, after said diamond tool machining.

8. The method according to claim 1, wherein said first material comprises any of alloys of copper, aluminium, and zinc.

9. The method according to claim 8, wherein said first material comprises brass.

10. The method according to claim 8, wherein said first material comprises an aluminum alloy.

11. The method according to claim 8, wherein said first material comprises a zinc alloy.

12. The method according to claim 1, wherein a said first material comprises a polymer.

13. The method according to claim 1, wherein said first material comprises an electrically conductive material.

14. The method according to claim 1, wherein said second material is different from said first material.

15. The method according to claim 1, wherein said second material comprises nickel-phosphorus.

16. The method according to claim 1, wherein coating said workpiece comprises coating with said thick layer of said second material by bulk chemical deposition.

17. The method according to claim 1, wherein coating said workpiece comprises coating with said thick layer of said second material by electrodeposition.

18. The method according to claim 1, wherein making said workpiece comprises any of deformation, stamping, and punching.

19. The method according to claim 1, wherein making said workpiece comprising making said workpiece to be any of hollow and including at least one mounting foot.

20. The method according to claim 1, wherein said timepiece display or hand-fitting component comprises at least one of a hand, an applique, a numeral, a symbol, a monogram, an indicator, an index, and an aperture surround.

21. The method according to claim 1, wherein said surface condition is further comprised between 20 nm Ra and 50 nm Ra.

* * * * *